US009399223B2

(12) United States Patent
Dial et al.

(10) Patent No.: US 9,399,223 B2
(45) Date of Patent: Jul. 26, 2016

(54) SYSTEM AND METHOD OF FORMING NANOSTRUCTURED FERRITIC ALLOY

(71) Applicant: General Electric Company, Schenectady, NY (US)

(72) Inventors: Laura Cerully Dial, Clifton Park, NY (US); Richard DiDomizio, Charlton, NY (US); Matthew Joseph Alinger, Delmar, NY (US); Shenyan Huang, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 437 days.

(21) Appl. No.: 13/953,845

(22) Filed: Jul. 30, 2013

(65) Prior Publication Data

US 2015/0033912 A1 Feb. 5, 2015

(51) Int. Cl.

| | |
|---|---|
| ***B02C 17/16*** | (2006.01) |
| ***C22C 1/10*** | (2006.01) |
| ***C22C 32/00*** | (2006.01) |
| ***C22C 33/02*** | (2006.01) |
| *B22F 9/04* | (2006.01) |

(52) U.S. Cl.

CPC ..... *B02C 17/16* (2013.01); *C22C 1/1084* (2013.01); *C22C 32/00* (2013.01); *C22C 32/001* (2013.01); *C22C 33/0228* (2013.01); *C22C 33/0285* (2013.01); *B22F 2009/041* (2013.01); *B22F 2009/043* (2013.01); *B22F 2999/00* (2013.01)

(58) Field of Classification Search

None

See application file for complete search history.

(56) References Cited

U.S. PATENT DOCUMENTS

| | | | | |
|---|---|---|---|---|
| 3,649,242 | A * | 3/1972 | Arias | C22C 1/1084 419/10 |
| 3,696,486 | A | 10/1972 | Benjamin | |
| 4,389,240 | A | 6/1983 | Erich et al. | |
| 4,564,390 | A | 1/1986 | Gupta et al. | |
| 4,634,062 | A * | 1/1987 | Berchem | C22C 38/44 241/184 |
| 4,778,542 | A | 10/1988 | Clemens | |
| 5,328,500 | A | 7/1994 | Beltz et al. | |
| 5,858,130 | A | 1/1999 | Bodnar et al. | |
| 6,485,583 | B1 | 11/2002 | Vine et al. | |
| 6,604,698 | B2 | 8/2003 | Verhoff et al. | |
| 8,357,328 | B2 | 1/2013 | Didomizio et al. | |
| 2007/0178019 | A1 * | 8/2007 | Downs | B01J 19/0046 422/400 |
| 2011/0142708 | A1 * | 6/2011 | Didomizio | B22F 3/15 419/19 |
| 2011/0250074 | A1 | 10/2011 | Didomizio et al. | |

OTHER PUBLICATIONS

Tables "Compositions of standard stainless steels" and "Compositions and microstructures of corrosion-resistant stainless steels", Advanced Materials and Processes, vol. 159, No. 12, Dec. 2001, pp. 63-64 and 78-79.*

Bhadeshia et al , "Mechanical Alloying, Case Study", Materials Science & Metallurgy, Course MP4, Thermodynamics and Phase Diagrams, Issue Date: 2005, 37 Pages.

* cited by examiner

*Primary Examiner* — George Wyszomierski

(74) *Attorney, Agent, or Firm* — Paul J. DiConza

(57) ABSTRACT

A system for mechanical milling and a method of mechanical milling are disclosed. The system includes a container, a feedstock, and milling media. The container encloses a processing volume. The feedstock and the milling media are disposed in the processing volume of the container. The feedstock includes metal or alloy powder and a ceramic compound. The feedstock is mechanically milled in the processing volume using metallic milling media that includes a surface portion that has a carbon content less than about 0.4 weight percent.

12 Claims, 3 Drawing Sheets

SYSTEM AND METHOD OF FORMING NANOSTRUCTURED FERRITIC ALLOY

STATEMENT REGARDING FEDERALLY SPONSORED RESEARCH AND DEVELOPMENT

This invention was made with Government support under contract number DE-EE0005573 awarded by the U.S. Department of Energy. The Government has certain rights in the invention.

BACKGROUND

The invention relates generally to a nanostructured ferritic alloy. More particularly the invention relates to system and method of forming a nanostructured ferritic alloy having low impurities.

Gas turbines operate in extreme environments, exposing the turbine components, especially those in the turbine hot section, to high operating temperatures and stresses. In order for the turbine components to endure these conditions, they are manufactured from a material capable of withstanding these severe conditions. As material limits are reached, one of two approaches is conventionally used in order to maintain the mechanical integrity of hot section components. In one approach, cooling air is used to reduce the part's effective temperature. In a second approach, the component size is increased to reduce the stresses. However, these approaches can reduce the efficiency of the turbine and increase the cost.

In certain applications, super alloys have been used in these demanding applications because they maintain their strength at up to 90% of their melting temperature and have excellent environmental resistance. Nickel-based super alloys, in particular, have been used extensively throughout gas turbine engines, e.g., in turbine blade, nozzle, wheel, spacer, disk, spool, blisk, and shroud applications. In some lower temperature and stress applications, steels may be used for turbine components. However, conventional steels generally do not meet all of the mechanical property requirements for high temperature and high stress applications. Designs for improved gas turbine performance require alloys that balance cost with higher temperature capability.

Nickel-based super alloys used in heavy-duty turbine components require specific elaborate processing steps in order to achieve the desired mechanical properties, including three melting operations: vacuum induction melting (VIM), electro slag remelting (ESR), and vacuum arc remelting (VAR). Nano structured ferritic alloys (NFAs) are an emerging class of alloys that exhibit exceptional high temperature properties, thought to be derived from nanometer-sized oxide clusters that are precipitated in the alloys. These oxide clusters are present at high temperatures, providing a strong and stable microstructure during service. Unlike many nickel-based super alloys, which require a cast and wrought (C&W) process to be followed to obtain necessary properties, NFAs are manufactured via a different processing route that requires fewer melting steps, but includes hot consolidation following a mechanical alloying step.

Mechanical alloying requires the use of powder metal and milling media to enhance the transfer of kinetic energy to the powder metal. During mechanical alloying, impurities including, but not limited to carbon, oxygen, nitrogen, argon and hydrogen can be absorbed into the alloy, leading to detrimental second phases and/or thermally induced porosity for example. Hence, there is a need to limit and reduce the impurity phases that are introduced into the NFAs during manufacturing.

BRIEF DESCRIPTION

In one embodiment, a system is provided. The system includes a container, a feedstock, and milling media. The container encloses a processing volume. The feedstock and the milling media are disposed in the processing volume of the container. The feedstock includes metal or alloy powder and a ceramic compound. The milling media includes a surface portion having a carbon content less than about 0.4 weight percent.

In one embodiment, a method is provided. The method used is for mechanically milling a feedstock. The feedstock includes metal or alloy powder and a ceramic compound. The feedstock is introduced in to the processing volume of a container. The feedstock is mechanically milled in the processing volume using metallic milling media that includes a surface portion having a carbon content less than about 0.4 weight percent.

DETAILED DESCRIPTION

Embodiments of the invention described herein address the noted shortcomings of the state of the art. One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," and "the," are intended to mean that there are one or more of the elements. The terms "comprising," "including," and "having" are intended to be inclusive and mean that there may be additional elements other than the listed elements. All ranges disclosed herein are inclusive of the endpoints, and the endpoints are combinable with each other.

Approximating language, as used herein throughout the specification and claims, may be applied to modify any quantitative representation that could permissibly vary without resulting in a change in the basic function to which it may be about related. Accordingly, a value modified by a term such as "about" is not limited to the precise value specified. In some instances, the approximating language may correspond to the precision of an instrument for measuring the value.

Figure 1:
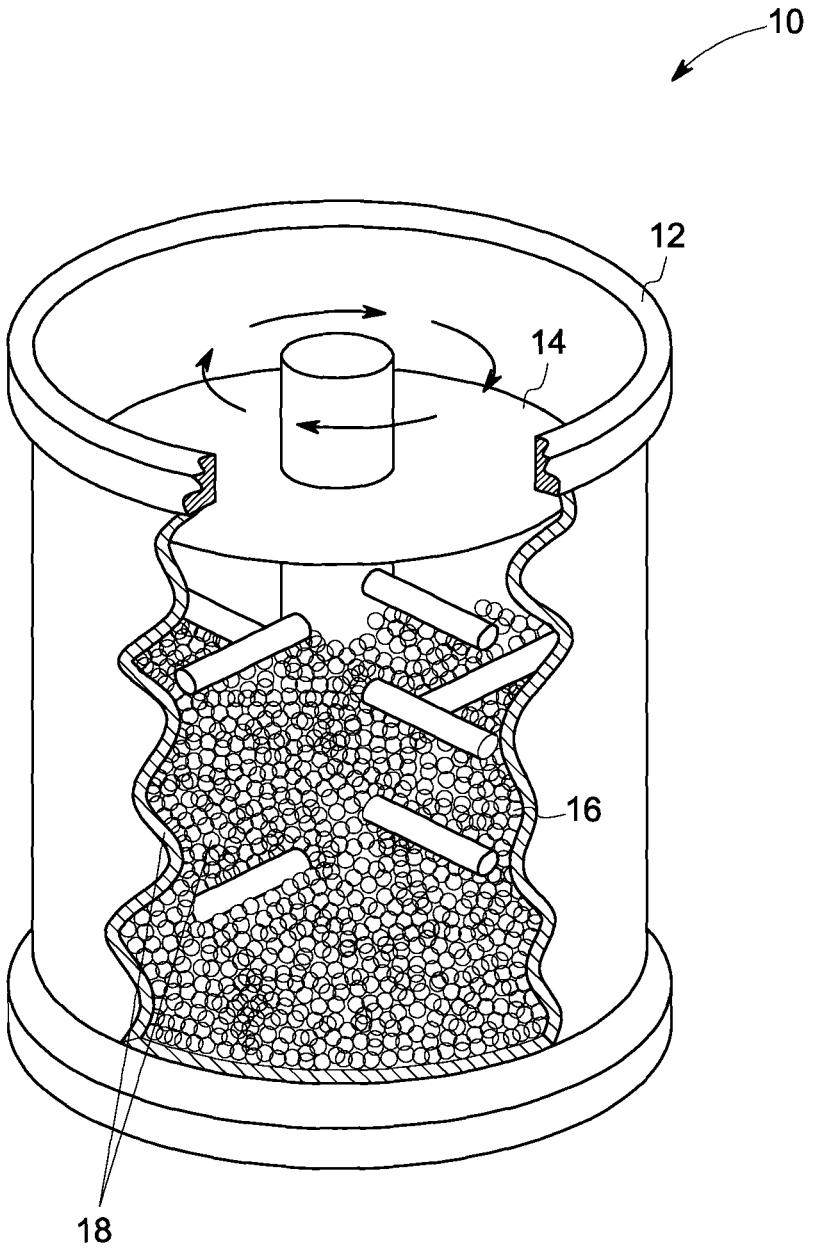
FIG. 1 is a schematic diagram of a system in accordance with one embodiment of the invention.

In one embodiment, a system 10 is provided as shown in FIG. 1. The system may be any powder mixing, or powder processing equipment. In one embodiment, the system used herein is a mechanical alloying equipment, such as a mill. Non-limiting examples of the mill will include an attritor mill and ball-mill. In one embodiment, the system is a high-energy attritor mill. Mechanical alloying is a solid-state powder processing technique involving the repeated working of powder particles in a high-energy mill. The powder particles may be ground, cold-welded, and fractured during the mechanical alloying process. A high-energy ball mill 10 may be used for processing powder particles that may have to undergo mechanical alloying process.

The system 10 may include a cylindrical or spherical container 12 having a processing volume 14 that is used for grinding powder materials such as for example metallic particles, and ceramic materials. In a normal milling process, the container is partially filled with the materials to be ground and some milling medium and normally rotated in one, two, three, or more axes. The milling process results in the repeated cold welding and fracturing of powder particles. Depending on the materials to be ground, different milling media 16 may be used. The "milling media" as used herein is a plurality of media, such as balls, rods, or beads that can be used to grind and cold-weld the particles. In general, the milling media 16 may include ceramic balls, flint pebbles and metallic balls. Key properties of milling media 16 include its size, density, hardness, and composition.

The materials to be processed inside the processing volume 14 of the container are referred to as "feedstock" 18. The processing volume 14 is the total volume available for milling enclosed by the container 12 walls.

Different factors such as for example, extent of filling of the mill, ratio of the milling media 16 verses feedstock 18, the toughness and smoothness of the milling media 16, speed of the mill rotation, and time of milling, have an effect on the final size and composition of the material that are processed in the mill. In the mechanical alloying process, the mill is used for fracturing and cold welding of the materials, thereby producing alloys from the starting powder.

The feedstock 18 used herein includes metal powder, alloy powder, or metal and alloy powder. As used herein, the metal powder is made of a metallic element and the alloy includes two or more metallic elements in a matrix. In one embodiment, the feedstock 18 includes an iron-containing alloy powder. The concentration of iron in the alloy powder may be greater than about 50 wt %. In one embodiment, the iron content in the alloy powder is greater than about 70 wt %.

In one embodiment, the alloy powder of the feedstock 18 includes iron and chromium. Chromium imparts both phase stability and corrosion resistance to the alloy, and may thus be included in the alloy in amounts of at least about 5 wt % of the alloy. Amounts of up to about 30 wt % of the alloy may be included. In one embodiment, chromium in the alloy powder is in a range from about 9 wt % to about 14 wt % of the alloy.

In one embodiment, the metal or alloy powder account for more than about 92 wt % of the feedstock 18. Along with the metal or alloy powder, the feedstock 18 further includes one or more ceramic compound. In one embodiment, the amount of ceramic compound in the feedstock 18 may be less than about 5 wt % of the feedstock 18. In one embodiment, the feedstock 18 includes ceramic compound at a concentration in a range from about 0.05 wt % to about 4 wt %. The ceramic compound as used herein may include an oxide, carbide, nitride, boride, or any combinations thereof. In one embodiment, the ceramic compound is an oxide.

In a particular embodiment, the ceramic compound used herein is a simple oxide. A "simple oxide" as used herein is an oxide phase that has one non-oxygen element, such as, for example, yttrium oxide or titanium oxide. In one embodiment, the ceramic compound is a complex oxide. A "complex oxide" as used herein is an oxide phase that includes more than one non-oxygen elements. The complex oxide may be a single oxide phase having more than one non-oxygen elements such as, for example, ABO, where A and B represent non-oxygen elements; or may be a mixture of more than one simple oxide phases (having one non-oxygen element) such as, for example $A_xB_yO_z$.

In one embodiment, the feedstock 18 may include titanium and yttrium. Yttrium oxide, titanium, or a combination of yttrium oxide and titanium may be present as a part of the feedstock 18. In one embodiment, the concentration of yttrium oxide is in a range from about 0.1 wt % to about 3 wt % of the feedstock 18.

In one embodiment, the feedstock 18 disposed in the processing volume may be starting materials for a nanostructured ferritic alloy (NFA). The starting materials after high energy milling in the container may be subjected to a high temperature consolidation resulting in an alloy matrix having some dispersed nanofeatures.

As used herein, the term "nanofeatures" means particles of matter having a largest dimension less than about 100 nanometers in size. The nanofeatures used herein are typically in-situ formed in NFA by the dissolution of the initial added oxide and the precipitation of nanometer-sized clusters of a modified oxide that can serve to pin the alloy structure, thus providing enhanced mechanical properties.

The feedstock 18 in the processing volume of the container may have to be milled with high speed and energy to get the desired result after milling. Different factors that may influence the milling energy and the final milled materials include strength, hardness, size, speed, and ratio of the milling media 16 with respect to the feedstock 18 material, and overall time and temperature of milling. The milling media 16 may be desired to have higher strength and hardness than the overall feedstock 18 material. In one embodiment, the feedstock 18 is mechanically milled at a temperature in a range from about 20° C. to about 150° C.

In an NFA, the compositional impurities may have significant effect on the mechanical properties. Hence it is desired to reduce the compositional impurities added during the mechanical milling process. A modification in the high energy milling process may be required to reduce the amount of non-desired elements imparted into a mechanically alloyed (MA) material. NFA's, in particular, are normally milled using high carbon (~1 wt % C) milling media. This media is used as it has the high hardness required to withstand the high kinetic energy process, and is readily available. It has been experimentally found by the inventors that the presence of carbon in NFAs can lead to detrimental phase formation upon consolidation of the alloy.

In one embodiment of the present invention, a low carbon milling media 16 is used to reduce carbon absorption from the milling media 16 during milling. It has been experimentally demonstrated by the inventors that the final carbon content of the mechanically alloyed material may be considerably reduced through the selection of an alternate milling media to the high-carbon milling media. Specifically, the carbon content in the media is lowered, while maintaining an adequate hardness to withstand the milling process. The carbon content of the milled product may further be reduced by selecting an alternative alloy with high hardness and ultra-low carbon content.

In one embodiment, the milling media 16 used herein includes a ferrous alloy. More specifically, the milling media 16 is a ferrous-based alloy with carbon content less than about 0.4 wt % and having a Rockwell hardness greater than about 40 HRC. In one embodiment, the ferrous based milling media 16 includes other metallic elements such as nickel, chromium, manganese, aluminum, cobalt, molybdenum, titanium, or a combination of any of these in a small amount. For example, one of the milling media 16 used herein is a ferrous alloy having nickel at <20 wt %, cobalt<10 wt %, molybdenum<5 wt %, titanium<1 wt %, aluminum, silicon, manganese, sulfur, phosphorus, zirconium wt %, and boron at a concentration less than 0.2 wt % each, and a carbon of about 0.03 wt %. In another example, the milling media 16 used herein is a ferrous alloy having chromium at <20 wt %, nickel and cobalt<10 wt %, molybdenum<6 wt %, aluminum, silicon, and manganese<2 wt %, sulfur, and phosphorus at a concentration less than 0.02 wt % each, and a carbon of about 0.01 wt %.

In one embodiment, a stainless steel milling media 16 with less than about 0.4 wt % carbon is used and found to subsequently reduce the carbon content of the milled product. In one embodiment, the milling media 16 used herein includes a martensitic matrix. In one embodiment, the milling media 16 has predominantly (>90 volume %) martensitic matrix and includes a small volume of other precipitated intermetallic phases. Milling media 16 with bainitic matrix may also be used for the mechanical alloying of the feedstock 18. In one embodiment, the milling media 16 may be formed of precipitate hardened steel. In one embodiment, the milling media 16 used to mill the feedstock 18 have a toughness value greater than about 10 MPa $m^{1/2}$.

Figure 2A:
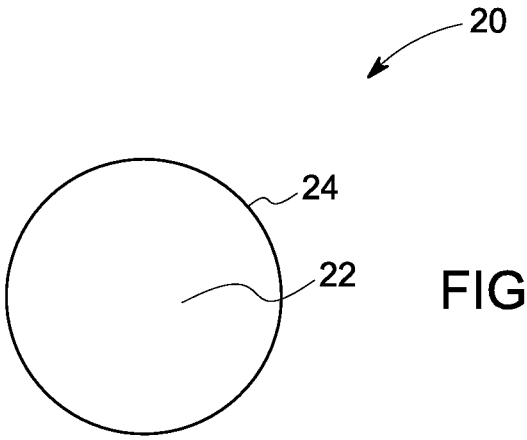
FIG. 2A is a schematic representation of carbon content of an exemplary ball of the milling media, in accordance with one embodiment of the invention.
Figure 2B:
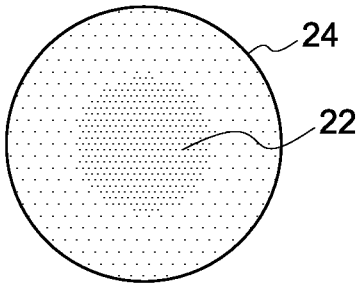
FIG. 2B is a schematic representation of carbon content of an exemplary ball of the milling media, in accordance with one embodiment of the invention.
Figure 2C:
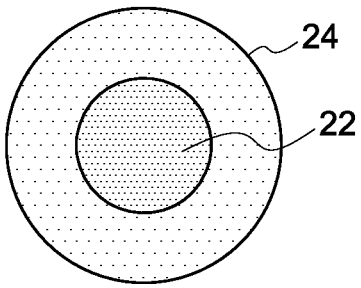
FIG. 2C is a schematic representation of carbon content of an exemplary ball of the milling media, in accordance with one embodiment of the invention.

In one embodiment, the milling media 16 may comprise balls, beads, or rods having interior portion and surface portion. FIGS. 2A, 2B, and 2C schematically show different non-limiting structure with respect to carbon content in the interior portion 22 and surface portion 24 of an exemplary ball 20 of the milling media 16.

In one embodiment, the ball 20 has similar composition and carbon content all throughout the volume of the ball 20 as schematically depicted in FIG. 2A. In this embodiment, the interior portion 22 and the surface portion 24 have similar level of carbon content and the content of carbon is less than about 0.4 wt % of the ball 20.

In one embodiment, the ball 20 has higher carbon content in the interior portion 22 of the ball 20, as compared to the carbon content in the surface portion 24 as schematically depicted in FIGS. 2B and 2C. In one embodiment, there is decreasing gradient in the carbon content from the interior portion 22 to the surface portion 24 as shown in FIG. 2B. In this embodiment, the carbon content in the inner most part of the ball 20 may be greater than about 1 wt %, and the surface portion 24 may have the carbon content less than about 0.4 wt %. The carbon content of the surface portion may further be less than about 0.1%. The surface portion as used herein is not limited by any particular thickness from the surface, unless the thickness of the surface portion is explicitly disclosed.

In one embodiment, the ball 20 includes a core comprising inner portion 22, and a shell comprising the surface portion 24 as shown in FIG. 2C. In this embodiment, the core may have higher carbon content as compared to the shell. In the embodiment depicted in FIG. 2C, the core and shell regions are distinguishable and have a marked change in the carbon content unlike in the embodiment depicted in FIG. 2B, where there may be a continuous gradation in the carbon content. The gradation may be a radial gradation, with the carbon content decreasing from center of the ball 20 to the outermost surface of the ball 20. In one embodiment, the core is the interior portion 22 and the shell is the surface portion 24, and the core has a carbon content equal to or greater than about 0.4 wt % and the shell has a carbon content less than about 0.4 wt %. In one embodiment, the core has carbon content greater than about 1 wt % and the shell has a carbon content less than about 0.2 wt %.

The weight percentage of carbon at any region of the ball 20 as used hereinabove is the percentage of carbon in the overall content of the ball 20 at that region. For example, a carbon content greater than 1 wt % at the core as depicted in FIG. 2C is the weight percentage of carbon in the overall contents of the core region. Similarly the carbon weight percentage in the shell is based on the overall contents of the shell region. The composition (other than carbon) and structure (including microstructure) of the core and shell may or may not be same. Hence, the overall weight percent of carbon in the ball 20 may not always be the weighted average of the carbon contents of the core and shell regions.

In one embodiment, the structure of ball 20 is considered as the structure of substantial part of the milling media 16. Therefore, "interior portion of the milling media" used herein indicates the interior portion of a substantial part of the milling media 16. Similarly, "surface portion of the milling media" would mean the surface portions of the substantial part of the milling media 16. In one embodiment, the structure of the milling media 16 is considered as equivalent to the structure of ball 20.

In one embodiment, the milling media 16 may have a mix of different kinds of balls depicted in FIGS. 2A, 2B, and 2C. However, surface portion of more than 95% of the milling media 16 has the carbon content less than about 0.4 wt %.

Mechanical alloying is generally performed in an air, or inert gas environment such as, for example, argon or nitrogen. The inventors observed that when milling under air or an inert gas environment, the environmental gas becomes incorporated and trapped in the milled material as an impurity. Upon high temperature exposure, these gas bubbles expand, causing a porous structure. This thermally induced porosity may reduce the mechanical properties of the material. Therefore, in one embodiment, the feedstock 18 is milled under a rough vacuum, rather than in an inert gas environment. A "rough vacuum" as used herein indicates an environmental pressure less than the atmospheric pressure in the process volume of the container. In one embodiment, the pressure inside the container in the processing volume is less than about $10^{-4}$ atmosphere. In one embodiment, the pressure is less than about $10^{-5}$ atmosphere. This low pressure is maintained in the process volume throughout the milling process.

In one embodiment, the milled product is further heat-treated and formed into an NFA. In one embodiment, the NFA formed by the system and method described herein includes an alloy matrix that is in the form of the ferritic body-centered cubic (BCC) phase.

EXAMPLES

The following examples illustrate methods, materials and results, in accordance with specific embodiments, and as such should not be construed as imposing limitations upon the claims. All components are commercially available from common chemical suppliers.

Figure 3:
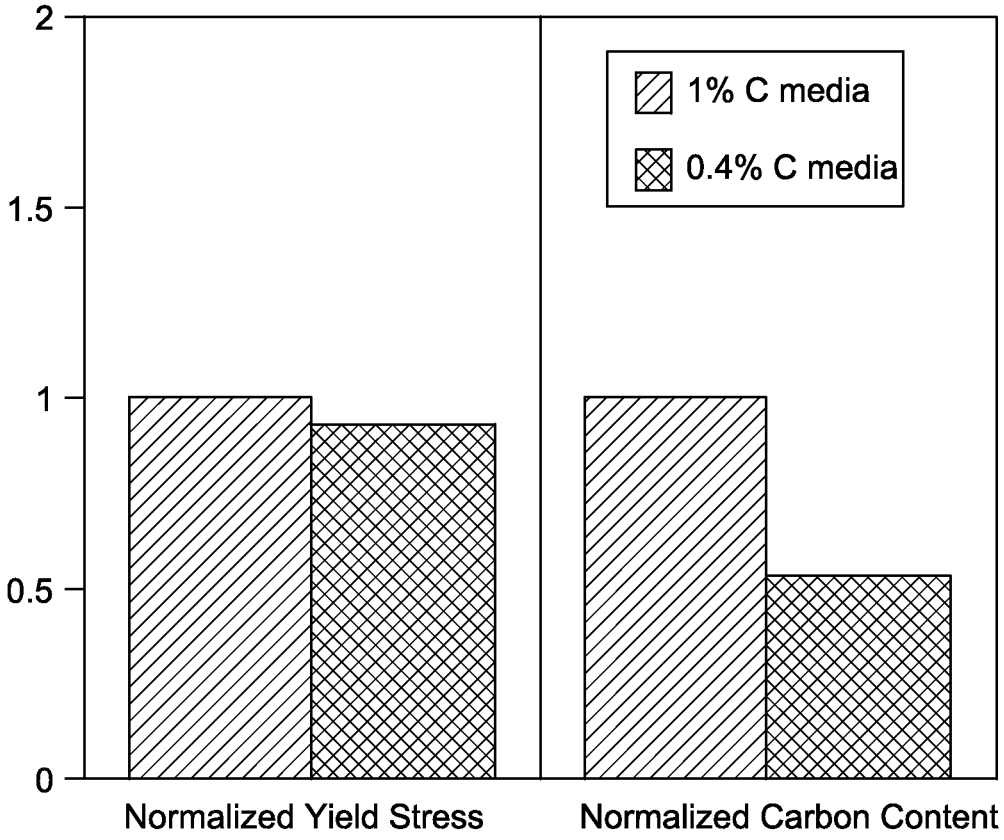
FIG. 3 is a graph depicting the comparison of yield stress and carbon content of a component prepared by the powder milled using high carbon content milling media verses a low carbon content milling media, in accordance with one embodiment of the invention.

Two batches of powders with the same composition and size ranges were selected for experimentally determining the effect of carbon content of the milling media used for milling these powders. The two batches were milled with high energy, maintaining same processing conditions except the change in the milling media. For the first batch, a milling media having about 1 wt % carbon was used, while for the second batch, the milling media used was having about 0.4 wt % carbon. The carbon contents of the powders after milling were measured using combustion infrared detection by following ASTM E 1019-11 procedure. The powders were then consolidated using a hot isostatic pressing (HIP) and forge process under the same conditions. The yield stresses of the forged parts prepared from powders of both batches were then measured. FIG. 3 shows the experimentally determined yield stress and carbon contents of these two parts. The values were normalized with respect to the material milled with 1 wt % carbon media. The difference in yield stress observed was negligible (within the error limits) as compared to the variation typically measured between parts prepared using different batches of powders that were milled using milling media having carbon content of 1 wt % carbon. Therefore, it is noted that the reduction of carbon content in the milling media used for milling a batch of powders did not substantially reduce the yield stress of the forged parts formed from that batch of powders.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a container enclosing a processing volume;

a feedstock comprising metal or alloy powder and a ceramic compound in the processing volume; and a metallic milling media disposed in the processing volume, wherein the metallic milling media comprises a surface portion having a carbon content less than about 0.4 weight percent, and wherein an interior portion of the metallic milling media has an increased carbon content as compared to the surface portion.

2. The system of claim 1, wherein the ceramic compound comprises an oxide, carbide, nitride, boride, or any combinations thereof.

3. The system of claim 1, wherein a concentration of the ceramic compound is less than about 8 wt % of the feedstock.

4. The system of claim 3, wherein the concentration of the ceramic compound is in a range from about 0.05 wt % to about 4 wt %.

5. The system of claim 1, wherein the metallic milling media comprises a ferrous alloy.

6. The system of claim 5, wherein the metallic milling media comprises a martensitic matrix.

7. The system of claim 5, wherein the metallic milling media comprises a bainitic matrix.

8. The system of claim 1, wherein the surface portion of the metallic milling media has a toughness greater than about 10 MPa m1/2.

9. The system of claim 1, wherein a Rockwell hardness of the milling media is greater than about 40 HRC.

10. The system of claim 1, wherein the carbon content of the milling media decreases from the center of the media to the surface as a function of the radial direction.

11. The system of claim 1, wherein the milling media comprises a core-shell structure, the core comprising the interior portion and the shell comprising the surface portion.

12. The system of claim 11, wherein a carbon content in the core is equal to or greater than about 0.4 wt % of the interior portion, and a carbon content in the shell is less than about 0.4 wt % of the surface portion.

* * * * *